US009157220B2

(12) United States Patent
Ball et al.

(10) Patent No.: US 9,157,220 B2
(45) **Date of Patent: *Oct. 13, 2015**

(54) DRAIN ASSEMBLY FOR A BATHTUB AND THE LIKE

(71) Applicant: WCM Industries, Inc., Colorado Springs, CO (US)

(72) Inventors: William T. Ball, Colorado Springs, CO (US); Eric Pilarczyk, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 168 days.

This patent is subject to a terminal disclaimer.

(21) Appl. No.: 13/974,690

(22) Filed: Aug. 23, 2013

(65) Prior Publication Data

US 2013/0340163 A1 Dec. 26, 2013

Related U.S. Application Data

(63) Continuation-in-part of application No. 13/726,840, filed on Dec. 26, 2012, which is a continuation-in-part of application No. 13/461,422, filed on May 1, 2012, now Pat. No. 8,505,132, which is a (Continued)

(51) Int. Cl.

| | |
|---|---|
| ***E03C 1/22*** | (2006.01) |
| ***E03C 1/20*** | (2006.01) |
| ***E03C 1/23*** | (2006.01) |

(52) U.S. Cl.

CPC ... *E03C 1/20* (2013.01); *E03C 1/22* (2013.01); *E03C 1/2306* (2013.01)

(58) Field of Classification Search

CPC ..... E03C 1/24
USPC ..... 4/679–694
See application file for complete search history.

(56) References Cited

U.S. PATENT DOCUMENTS

| | | | |
|---|---|---|---|
| 37,956 | A | 3/1863 | Doytt |
| 427,478 | A | 5/1890 | McEvoy |
| 843,968 | A | 2/1907 | Sharp, Jr. |
| 1,213,466 | A | 1/1917 | Delanoy |

(Continued)

FOREIGN PATENT DOCUMENTS

| | | |
|---|---|---|
| CH | 346187 | 4/1960 |
| DE | 1163257 | 2/1964 |
| FR | 744099 | 2/1964 |

OTHER PUBLICATIONS definition of the term "diaphragm" found at: http://www.thefreedictionary.com/diaphragm, cited in Aug. 7, 2012 OA for U.S. Appl. No. 13/234,030.

(Continued)

*Primary Examiner* — Lori Baker
(74) *Attorney, Agent, or Firm* — Sheridan Ross P.C.

(57) ABSTRACT

A drain assembly including a drain pipe with a threaded portion and a nut is provided. The drain pipe includes a first end, an elbow portion, and a second end. The first end includes an annular flange and the threaded portion. To interconnect the drain assembly to a bathtub, the second end of the drain pipe is inserted through a drain port of the tub until the annular flange abuts a bottom wall of the tub. The nut is then threaded onto the threaded portion of the drain pipe to secure the drain pipe to the bathtub. The second end of the drain pipe is then interconnected to drain plumbing.

19 Claims, 19 Drawing Sheets

Related U.S. Application Data continuation-in-part of application No. 12/057,660, filed on Mar. 28, 2008, now Pat. No. 8,166,584, which is a continuation-in-part of application No. 10/732,726, filed on Dec. 10, 2003, now Pat. No. 8,302,220, which is a continuation-in-part of application No. 09/954,420, filed on Sep. 17, 2001, now Pat. No. 6,691,411.

(56) References Cited

U.S. PATENT DOCUMENTS

| | | | |
|---|---|---|---|
| 1,330,909 | A | 2/1920 | Sharp, Jr. |
| 1,518,599 | A | 12/1924 | Murray |
| 1,788,083 | A | 1/1931 | Church |
| 1,925,008 | A | 8/1933 | Schact |
| 1,977,177 | A | 10/1934 | De Flores |
| 2,044,253 | A | 6/1936 | Morris |
| 2,062,145 | A | 11/1936 | Pickop |
| 2,223,365 | A | 12/1940 | Groeniger |
| 2,374,815 | A | 5/1945 | Haas, Jr. |
| 2,444,340 | A | 6/1948 | Donahue |
| 2,832,081 | A | 4/1958 | Young |
| 2,915,903 | A | 12/1959 | Digby et al. |
| 2,993,655 | A | 7/1961 | O'Brien |
| 3,121,879 | A | 2/1964 | Young |
| 3,493,978 | A | 2/1970 | Hindman et al. |
| 3,742,525 | A | 7/1973 | Oropallo |
| 3,937,497 | A | 2/1976 | Studer |
| D248,133 | S | 6/1978 | Shames et al. |
| 4,092,745 | A | 6/1978 | Oropallo |
| 4,123,810 | A | 11/1978 | Oropallo |
| 4,135,258 | A | 1/1979 | Braga et al. |
| 4,146,939 | A | 4/1979 | Izzi |
| 4,233,697 | A | 11/1980 | Cornwall |
| 4,307,901 | A | 12/1981 | Orberg et al. |
| 4,352,213 | A | 10/1982 | Watts |
| 4,359,790 | A | 11/1982 | Chalberg |
| 4,371,991 | A | 2/1983 | Schrott |
| 4,387,914 | A | 6/1983 | Paulson et al. |
| 4,413,384 | A | 11/1983 | Lassche |
| 4,457,030 | A | 7/1984 | Burry |
| 4,553,625 | A | 11/1985 | Tsuge et al. |
| 4,683,597 | A | 8/1987 | Taylor et al. |
| 4,730,855 | A | 3/1988 | Pelletier |
| D296,816 | S | 7/1988 | Budzinski et al. |
| 4,813,745 | A | 3/1989 | Woody |
| 4,825,477 | A | 5/1989 | Aranda |
| 4,865,353 | A | 9/1989 | Osborne |
| 4,890,967 | A | 1/1990 | Rosenbaum |
| 4,920,582 | A | 5/1990 | Alker |
| 4,953,235 | A | 9/1990 | Cornwall |
| 5,025,509 | A | 6/1991 | Holt et al. |
| 5,257,648 | A | 11/1993 | Oropallo |
| 5,267,474 | A | 12/1993 | Ten Hoven |
| 5,273,077 | A | 12/1993 | Oropallo |
| 5,350,266 | A | 9/1994 | Espey et al. |
| 5,351,996 | A | 10/1994 | Martin |
| 5,377,361 | A | 1/1995 | Piskula |
| 5,417,460 | A | 5/1995 | Lunder |
| 5,507,501 | A | 4/1996 | Palmer |
| 5,590,916 | A | 1/1997 | Liu |
| 5,692,248 | A | 12/1997 | Ball |
| 5,745,931 | A | 5/1998 | Ball |
| 5,758,368 | A | 6/1998 | Ball |
| 5,786,054 | A | 7/1998 | Platusich et al. |
| 5,799,986 | A | 9/1998 | Corbett et al. |
| 5,815,895 | A | 10/1998 | Carlson et al. |
| 5,890,241 | A | 4/1999 | Ball |
| 5,957,514 | A | 9/1999 | Brookshire |
| 5,971,438 | A | 10/1999 | Johnson |
| 6,058,526 | A | 5/2000 | Parisi et al. |
| 6,066,119 | A | 5/2000 | Ball |
| 6,073,278 | A | 6/2000 | Ball |
| 6,085,363 | A | 7/2000 | Huber |
| 6,088,843 | A | 7/2000 | Francisco |
| 6,126,233 | A | 10/2000 | Gaetano et al. |
| 6,145,136 | A | 11/2000 | Parisi et al. |
| 6,192,531 | B1 | 2/2001 | Fritz et al. |
| 6,193,879 | B1 | 2/2001 | Bowman |
| 6,216,288 | B1 | 4/2001 | Bernau |
| 6,226,806 | B1 | 5/2001 | Ball |
| 6,263,518 | B1 | 7/2001 | Magtanong |
| 6,289,532 | B1 | 9/2001 | Fritz et al. |
| 6,295,664 | B2 | 10/2001 | Fritz et al. |
| 6,338,168 | B1 | 1/2002 | Valentine |
| 6,362,734 | B1 | 3/2002 | McQuade et al. |
| 6,418,570 | B1 | 7/2002 | Ball |
| 6,448,907 | B1 | 9/2002 | Naclerio |
| 6,484,331 | B2 | 11/2002 | Minnick |
| 6,530,722 | B1 | 3/2003 | Shaw et al. |
| 6,546,573 | B1 | 4/2003 | Ball |
| 6,606,753 | B2 | 8/2003 | Minnick |
| 6,618,875 | B1 | 9/2003 | Oropallo et al. |
| 6,637,050 | B1 | 10/2003 | Ball |
| 6,675,406 | B2 | 1/2004 | Ball |
| 6,681,420 | B1 | 1/2004 | Ball |
| 6,691,411 | B2 | 2/2004 | Ball |
| 6,696,943 | B1 | 2/2004 | Elrod et al. |
| 6,812,844 | B1 | 11/2004 | Burgess |
| 6,836,911 | B2 | 1/2005 | Minnick |
| 6,953,049 | B2 | 10/2005 | Kowalke |
| D517,666 | S | 3/2006 | Wilk, Jr. et al. |
| D523,123 | S | 6/2006 | Wilk, Jr. et al. |
| 7,127,752 | B2 | 10/2006 | Ball |
| 7,237,280 | B1 | 7/2007 | Holden et al. |
| 7,300,074 | B1 | 11/2007 | Paulson |
| D586,433 | S | 2/2009 | Price et al. |
| 7,503,083 | B2 | 3/2009 | Ball |
| D627,862 | S | 11/2010 | Ball |
| D627,863 | S | 11/2010 | Ball |
| D636,468 | S | 4/2011 | Ball |
| D637,696 | S | 5/2011 | Ball |
| 8,028,357 | B2 | 10/2011 | Ball |
| 8,166,584 | B2 | 5/2012 | Ball |
| D665,062 | S | 8/2012 | Ball |
| 8,302,220 | B2 | 11/2012 | Ball |
| 8,321,970 | B2 | 12/2012 | Ball |
| 8,505,132 | B2 | 8/2013 | Ball |
| 2002/0032926 | A1 | 3/2002 | Lewis |
| 2003/0024568 | A1* | 2/2003 | Bowman ..... 137/217 |
| 2003/0151281 | A1 | 8/2003 | Williams |
| 2004/0055083 | A1 | 3/2004 | Ball |
| 2004/0055084 | A1 | 3/2004 | Ball |
| 2004/0068792 | A1 | 4/2004 | Ball |
| 2004/0068793 | A1 | 4/2004 | Ball |
| 2004/0103474 | A1 | 6/2004 | Ball |
| 2004/0111797 | A1 | 6/2004 | Ball |
| 2006/0085907 | A1 | 4/2006 | Ball |
| 2007/0007763 | A1 | 1/2007 | Deaton |
| 2008/0148477 | A1 | 6/2008 | Shafik |
| 2008/0155745 | A1 | 7/2008 | Burr |
| 2008/0196161 | A1 | 8/2008 | Ball |
| 2009/0261579 | A1 | 10/2009 | Spears |
| 2011/0209279 | A1 | 9/2011 | Ball |
| 2012/0005824 | A1 | 1/2012 | Ball |
| 2013/0055494 | A1 | 3/2013 | Ball |
| 2013/0180045 | A1 | 7/2013 | Ball et al. |
| 2013/0269100 | A1 | 10/2013 | Ball et al. |

OTHER PUBLICATIONS

"New WATCO Eliminator Bath Waste", WATCO, as early as Aug. 8, 2001, pp. 1-2.

"Tubular Plastic-Innovator® 590", Woodford Manufacturing Company, first sold Aug. 16, 2001, pp. 1-2.

"WCM Industries-Freezeless Faucets, Yard Hydrants and Bath Wastes", as early as Aug. 2000, available at http://www.woodfordmfg.com/, printed on Sep. 15, 2005, p. 1.

Official Action for U.S. Appl. No. 10/732,726, mailed Mar. 28, 2005 (Restriction Requirement).

Official Action for U.S. Appl. No. 10/732,726, mailed May 23, 2005.

Official Action for U.S. Appl. No. 10/732,726, mailed Oct. 24, 2005.

(56) References Cited

OTHER PUBLICATIONS

Official Action for U.S. Appl. No. 10/732,726, mailed May 19, 2006.
Official Action for U.S. Appl. No. 10/732,726, mailed Jan. 30, 2008.
Official Action for U.S. Appl. No. 10/732,726, mailed Jun. 2, 2008.
Official Action for U.S. Appl. No. 10/732,726, mailed Aug. 20, 2008.
Official Action for U.S. Appl. No. 10/732,726, mailed Nov. 17, 2008.
Official Action for U.S. Appl. No. 10/732,726, mailed Dec. 9, 2008.
Official Action for U.S. Appl. No. 10/732,726, mailed May 1, 2008.
Official Action for U.S. Appl. No. 10/732,726, mailed Sep. 4, 2009.
Official Action for U.S. Appl. No. 10/732,726, mailed Apr. 15, 2010.
Official Action for U.S. Appl. No. 10/674,862, mailed Mar. 28, 2005.
Official Action for U.S. Appl. No. 10/674,862, mailed Aug. 18, 2004.
Notice of Allowance for U.S. Appl. No. 10/674,862, mailed Aug. 24, 2006.
Official Action for U.S. Appl. No. 10/674,862, mailed Oct. 6, 2005.
Official Action for U.S. Appl. No. 10/674,862, mailed Sep. 20, 2005.
Official Communication for U.S. Appl. No. 10/674,862, mailed May 23, 2008.
Examiner's Answer for U.S. Appl. No. 10/674,862, mailed May 15, 2008.
Official Action for U.S. Appl. No. 10/674,862, mailed May 1, 2007.
Official Action for U.S. Appl. No. 10/674,862, mailed Dec. 21, 2006.
Notice of Allowance for U.S. Appl. No. 10/738,772, mailed Aug. 1, 2006.
Official Action for U.S. Appl. No. 10/738,772, mailed May 11, 2006.
Official Action for U.S. Appl. No. 10/738,772, mailed Mar. 27, 2006.
Official Action for U.S. Appl. No. 10/738,772, mailed Aug. 2, 2005.
Official Action for U.S. Appl. No. 10/738,772, mailed May 13, 2005.
Official Action for U.S. Appl. No. 10/738,772, mailed Mar. 11, 2005.
Official Action for U.S. Appl. No. 10/738,772, mailed Sep. 17, 2004.
Official Action for U.S. Appl. No. 10/738,765, mailed May 22, 2007.
Official Action for U.S. Appl. No. 10/738,765, mailed Jan. 13, 2006.
Official Action for U.S. Appl. No. 10/738,765, mailed Jun. 6, 2005.
Official Action for U.S. Appl. No. 10/738,765, mailed Apr. 13, 2006.
Notice of Allowability for Design U.S. Appl. No. 29/362,288, mailed Oct. 7, 2010.
Official Action for U.S. Appl. 10/732,726, mailed Oct. 25, 2010.
Official Action for U.S. Appl. No. 10/732,726, mailed May 9, 2011 9 pages.
Official Action for U.S. Appl.No. 12/057,660, mailed Nov. 3, 2011 9 pages.
Official Action for U.S. Appl. No. 10/732,726, mailed Nov. 16, 2011 9 pages.
Notice of Allowance for U.S. Appl. No. 12/057,660, mailed Mar. 7, 2012 5 pages.
Official Action for U.S. Appl. No. 29/378,602, mailed Mar. 9, 2012 6 pages Restriction Requirement.
Official Action for U.S. Appl. No. 29/378,602, mailed Mar. 27, 2012 5 pages.
Notice of Allowance for U.S. Appl. No. 29/378,602, mailed Jun. 21, 2012 7 pages.
Official Action for U.S. Appl. No. 13/461,422 mailed Dec. 27, 2012 9 pages.
Notice of Allowance for U.S. Appl. No. 13/461,422 mailed Apr. 18, 2013 6 pages.
Notice of Allowance for U.S. Appl. No. 13/726,840, mailed Apr. 27, 2015 7 pages.

* cited by examiner

DRAIN ASSEMBLY FOR A BATHTUB AND THE LIKE

CROSS REFERENCE TO RELATED APPLICATIONS

This application is a continuation-in-part of U.S. patent application Ser. No. 13/726,840, filed Dec. 26, 2012, which is a continuation-in-part of U.S. patent application Ser. No. 13/461,422, filed May 1, 2012, now U.S. Pat. No. 8,505,132, which is a continuation-in-part of U.S. patent application Ser. No. 12/057,660, filed Mar. 28, 2008, now U.S. Pat. No. 8,166, 584, which is a continuation-in-part of U.S. patent application Ser. No. 10/732,726, filed Dec. 10, 2003, now U.S. Pat. No. 8,302,220, which is a continuation-in-part of U.S. patent application Ser. No. 09/954,420, filed Sep. 17, 2001, now U.S. Pat. No. 6,691,411. The entire disclosures of the above-referenced patents and applications are incorporated by reference herein.

BACKGROUND OF THE INVENTION

The traditional method of interconnecting a drain and associated plumbing to a bathtub generally comprises engaging a flange associated with the drain pipe to the bottom surface of the bathtub while aligning an aperture of the flange and the drain outlet of the bathtub, which is a "blind" operation. Next, while maintaining the position of the flange, a strainer body, which includes an outwardly-extending flange, is inserted into the drain outlet and interconnected to the drain pipe wherein the strainer body flange is engaged on an inside surface of the bathtub. The strainer body has a threaded outer surface that interfaces with the threaded inner surface of the drain pipe. Tightening the strainer body onto the drain pipe rigidly mates the drain pipe to the bathtub. Often, a seal is also positioned between the drain pipe flange and bottom surface of the bathtub. The traditional installation method is cumbersome and difficult as it requires multiple components to be held in place during assembly.

In addition, traditional drain assemblies are difficult to test. More specifically, pipes associated with the bathtub drain and overflow outlet must be leak tested after installation. The leak test involves filling the entire plumbing system with water by way of a vent attached to the drain. After a predetermined amount of time, leaks will be apparent if the water level in the vent pipe falls. To perform the leak test, the drain outlet and overflow port is plugged or otherwise sealed. Because of risk of damage, plumbers prefer not to use the final closure valve, i.e. stopper, to block the drain. Hence, the common testing method requires the removal of a plumber-supplied plug, which adds a step to the installation method.

Thus, a long felt need exists for a drain assembly that can be installed by one individual that also facilitates leak testing.

SUMMARY OF THE INVENTION

It is one aspect of the present invention to provide a drain assembly that can be installed by one individual. More specifically, in one embodiment of the present invention a drain pipe having a threaded outer surface that receives a nut is provided. The upper edge of the drain pipe includes an outwardly-extending flange that engages the inner surface of the bathtub. The nut threadably engages the threaded portion of the drain pipe from beneath the tub which sandwiches the bottom wall of the bathtub between the flange and the nut. As used herein, a 'tub' may include, but is not limited to, a bathtub, a shower base, or any other fluid holding basin.

Because the drain pipe is positioned within the outlet from inside the bathtub and affixed with the nut after the drain pipe is supported by the bottom surface of the tub, one individual can install the contemplated drain assembly. After associating the drain pipe to the tub, the plumber can interconnect the drain pipe to the drain plumbing.

In one embodiment, the drain pipe includes a first end, a second end, and an elbow positioned therebetween. In one embodiment, a maximum diameter of the second end, the elbow portion, and a substantial portion of the first end is less than the diameter of the drain port. Thus, the second end of the drain pipe can be placed through the drain port of the tub and effectively "hang" from the bottom surface of the tub. More specifically, the first end includes an annular flange that has a maximum diameter that is larger than the diameter of the drain port. When positioned in this fashion, the threaded portion will be positioned at least partially on the outside of the tub. The threaded portion has a maximum diameter that is less than the diameter of the drain port, and is configured to threadably receive a nut. A sealing element may be provided between the bottom surface of the tub and the nut to enhance the interconnection between the tub and the drain port.

In one embodiment, a drain pipe accommodates at least one of a selectively-removable membrane, an integrated strainer body, and a drain closure. The drain closure is also selectively removable from the drain pipe. The drain closure, i.e., stopper, is operatively interconnected to the drain pipe by a carrier post that is interconnected to cross bars integrated into or selectively associated with the drain pipe. For example, the crossbars of one embodiment are associated with a ring that is threadingly secured to an interior surface of the drain pipe or interference fit into the drain pipe.

Other embodiments of the present invention do not require a strainer body. More specifically, a tapped hole or boss for the receipt of a drain stopper may be integrated into the elbow or other portions of the drain pipe. Furthermore, crossbars and hubs for receiving drain stoppers may be integrated into the drain pipe. In still yet another embodiment of the present invention, crossbars for receiving a drain assembly are associated with the ring that fits within the drainpipe. The ring may be interference fit within the drain pipe or threadingly engaged to threads located in the drainpipe.

Regardless of whether a strainer body or other member is used to receive a drain stopper assembly, embodiments of the present invention are able to receive stoppers of various types and manufacturers. More specifically, Push/Pull drain closure devices, which are disclosed in U.S. Pat. No. 6,418,570, Lift and Turn drain closure devices, which are disclosed in U.S. Pat. No. 5,758,368, and Pressflo™ drain closure devices, which are disclosed in U.S. Pat. No. 6,226,806, may accommodated. This list is not exhaustive, and one of skill in the art will appreciate that other drain closure devices may be used in conjunction with the contemplated drainpipe without departing from the scope of the invention. Furthermore, claims concealing devices, such as Quick Trim™, which is disclosed in U.S. Pat. No. 7,503,083 may be used with the drainpipe disclosed herein. The entirety of the foregoing patent references are Incorporated by reference herein.

It is another aspect of the present invention to reduce leak points in the drain assembly. More specifically, one embodiment a present invention employs an elbow that is integrally interconnected to a straight portion of drain pipe that interconnects to the plumbing system of the dwelling, for example. In this embodiment, the elbow is fused, cast, or molded along with the linear portion of the drain pipe. Thus a cut is eliminated, which is often required to mate the linear portion of the drain pipe with the elbow. Further, a sealing joint is also eliminated. One of skill narrow appreciate that the reduction of the joints is advantageous.

The drain pipe, and related components may be made of common materials utilized in the art, including, but not limited to, copper, PVC, plastic, or any other suitable material.

It is another aspect of the present invention to provide a drain assembly adapted for interconnection to a tub having a drain port formed in a bottom wall, the drain port having a diameter, the drain assembly comprising: a drain pipe including a first portion, a second portion, and an elbow portion positioned between, and integrally connecting, the first portion and the second portion, the first portion including an annular flange and a threaded portion positioned between the annular flange and the elbow portion, wherein the threaded portion, the elbow portion, and the second portion have a maximum diameter that is less than the diameter of the drain port, and wherein the annular flange has a maximum diameter that is larger than the diameter of the drain port; and a nut configured to threadably engage the threaded portion of the drain pipe to secure the drain pipe to the bottom wall of the tub.

It is still yet another aspect of the present invention to provide a drain elbow adapted for interconnection to a tub having a drain port formed in a bottom wall, the drain port having a diameter, the drain elbow comprising: a first portion including an annular flange and an externally threaded portion, the annular flange having a maximum diameter that is larger than the diameter of the drain port; a second portion; and an elbow portion positioned between, and integrally connecting, the first portion and the second portion, wherein the externally threaded portion is positioned between the annular flange and the elbow portion, and wherein the externally threaded portion, the elbow portion, and the second portion have a maximum diameter that is less than the diameter of the drain port.

The Summary is neither intended nor should it be construed as being representative of the full extent and scope of the present disclosure. The present disclosure is set forth in various levels of detail in the Summary of the Invention as well as in the attached drawings and the Detailed Description and no limitation as to the scope of the claimed subject matter is intended by either the inclusion or non-inclusion of elements, components, etc. in this Summary of the Invention. Moreover, reference made herein to "the present invention" or aspects thereof should be understood to mean certain embodiments of the present disclosure and should not necessarily be construed as limiting all embodiments to a particular description.

Figure 1:
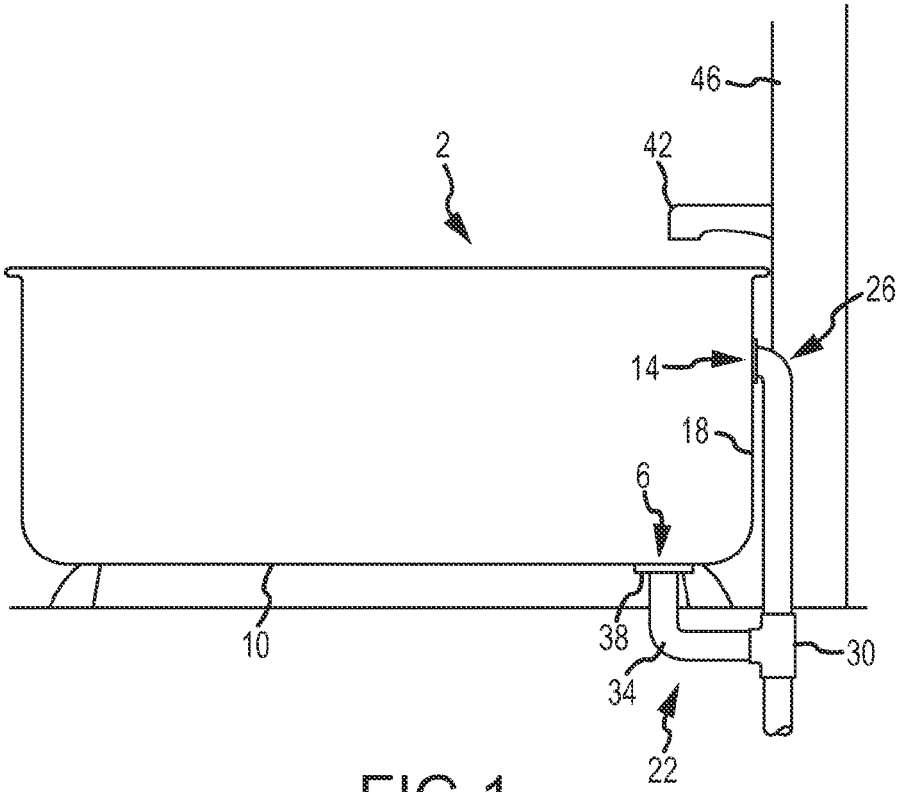
FIG. 1 is a side elevation view of one embodiment of a drain assembly interconnected to a bathtub.

To assist in the understanding of the drawings, the following is a list of components and associated numbering found in the drawings.

| # | Components |
|---|---|
| 2 | Bathtub |
| 6 | Drain port |
| 10 | Bottom wall |
| 14 | Overflow port |
| 18 | Sidewall |
| 22 | Drain assembly |
| 26 | Overflow assembly |
| 30 | Tee connector |
| 34 | Drain pipe |
| 38 | Nut |
| 42 | Faucet |

-continued

| # | Components |
|---|---|
| 46 | Interior wall |
| 50 | First end |
| 54 | Second end |
| 55 | Pipe adapter |
| 56 | Pipe |
| 57 | Primary drain |
| 58 | Annular flange |
| 62 | Threaded portion |
| 66 | Membrane |
| 70 | Upper surface |
| 74 | Lower surface |
| 78 | Elbow |
| 82 | Drain closure |
| 86 | Crossbar(s) |
| 90 | Cover |
| 94 | Crossbar insert |
| 98 | Hub |
| 102 | Threaded aperture |
| 106 | Carrier |
| 110 | Strainer body cover |
| 114 | Sealing element |
| 118 | Annular lip |
| 122 | Interior surface of drain pipe |
| 126 | Annular ring |
| 130 | Internally threaded portion |
| 134 | Threaded hole |
| 138 | Concave portion |
| 142 | Drain closure insert |
| 146 | Annular groove |
| 150 | Threads |
| 154 | Upper surface |
| 158 | Lower surface |
| 162 | Upper bulge |
| 166 | Lower bulge |
| 170 | Outer surface |

It should be understood that the drawings are not necessarily to scale. In certain instances, details that are not necessary for an understanding of the disclosure or that render other details difficult to perceive may have been omitted. It should be understood, of course, that the claimed subject matter is not necessarily limited to the particular embodiments illustrated herein.

DETAILED DESCRIPTION

Referring to FIGS. 1-11, a bathtub 2 includes a drain port 6 provided in a bottom wall 10 and an overflow port 14 provided in a sidewall 18. A drain assembly 22 is interconnected to the bottom wall 10 and associated with the drain port 6, and an overflow assembly 26 is interconnected to the sidewall 18 and associated with the overflow port 14. A tee connector 30 interconnects the drain assembly 22 and the overflow assembly 26. The drain assembly 22 includes a drain pipe 34, which may be generally L-shaped, that is attached to the bathtub 2 with a nut 38. The drain pipe 34 has a first end 50 associated with the bottom wall 10 of the bathtub 2, and a second end 54 that is interconnected to the tee connector 30. The first end 50 includes an annular flange 58 and an externally-threaded portion 62. A membrane 66 may be interconnected to the first end 50 of the drain pipe 34 to assist in leak testing.

The drain pipe 34 is interconnected to the bathtub 2 by first inserting the second end 54 through the drain port 6. The annular flange 58 is then engaged upon the upper surface 70 of the bottom wall 10. A sealant material, which would also create a leak barrier, may be placed on a lower surface of the annular flange 58 for further securing the annular flange to the bottom wall 10 of the bathtub 2. Next, a nut 38 is placed over the second end 54 of the drain pipe 34 and slid along the drain pipe 34 towards the bottom wall until it reaches the threaded portion 62 of the drain pipe 34. The nut 38 is threaded onto the threaded portion 62 of the drain pipe 34 and tightened against a lower surface 74 of the bottom wall 10 which rigidly connects the drain pipe 34 to the bathtub 2 around the drain port 6. A sealing element (See FIG. 2, Reference No. 114, for example) may additionally be positioned between the nut 38 and the lower surface 74 of the bottom wall 10.

The bottom wall 10 of the bathtub 2 is sandwiched between the annular flange 58 of the drain pipe 34 and the internally-threaded nut 38. After the first end of the drain pipe is interconnected to the bathtub 2, the second end 54 of the drain pipe 34 is connected to a tee connector 30. The drain system which includes the drain assembly 22, overflow assembly 26, and tee connector 30, is then leak tested. Finally, a drain closure is operatively associated with the first end 50 of the drain pipe 34. In the foregoing manner, a single individual can interconnect the drain assembly 22 to the drain port 6 of the bathtub 2.

The membrane 66, or diaphragm, is sealed to the first end 50 of the drain pipe 34 at the annular flange 58 for leak testing. In one embodiment, the membrane 66 is ultrasonically sealed to the first portion 50, and may be constructed of a material that is easily punctured or removable. For example, the membrane 66 may be constructed of a plastic material, flexible rubber, or the like. After a successful leak test, a plumber can remove the membrane 66 with a sharp object, as disclosed in related U.S. Pat. No. 8,302,220.

In most instances a drain closure 82 is associated with the first end 50 of the drain pipe 34. The drain closure 82 can be of any conventional type, including Lift and Turn, Foot-actuated, or PUSH-PULL™ closures to name a few, which are referred to above. Likewise, a PRESFLO™ drain closure, such as the one described in U.S. Pat. No. 4,457,030 to Burry and U.S. Pat. No. 6,226,806, which are incorporated by reference herein, can be used in conjunction with some embodiments of the present invention. The drain pipe 34 may include a crossbar 86 and hub 98, which are typically found in strainer bodies. The hub secures a carrier that operatively receives the stopper. The crossbar 86 may be integrated into the drain pipe or otherwise interconnected thereto. A cover 90 may be secured to the flange 58 to substantially cover the same and to provide a finished appearance. The cover 90 may be comprised of a trim device that effectively conceals the annular flange 58 as disclosed in U.S. Pat. No. 7,503,083 and related U.S. Patent Application Publication Nos. 2011/0209279 and 2013/0055494, which are incorporated by reference herein.

Figure 3:
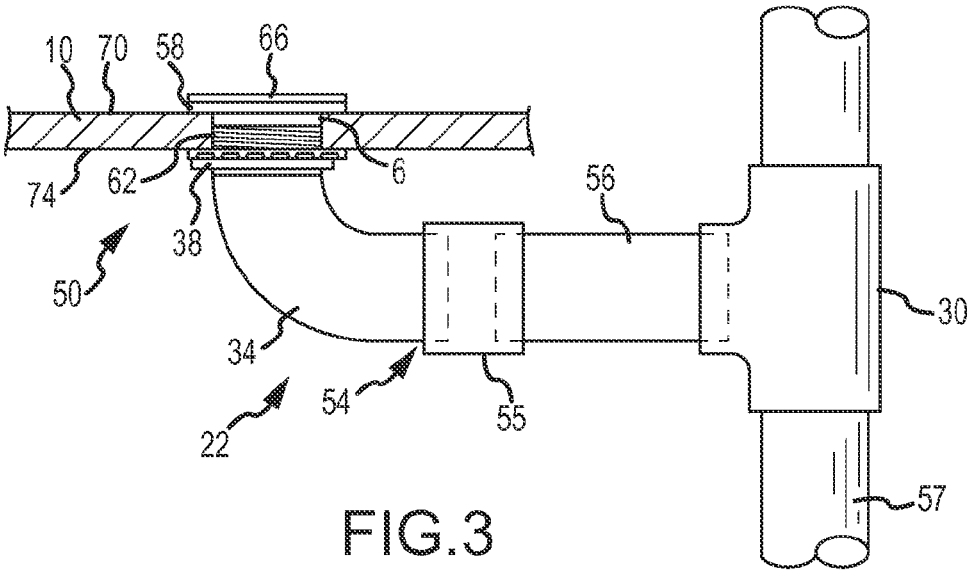
FIG. 3 is a side elevation view of another embodiment of a drain assembly interconnected to a bottom wall of the bathtub.
Figure 4:
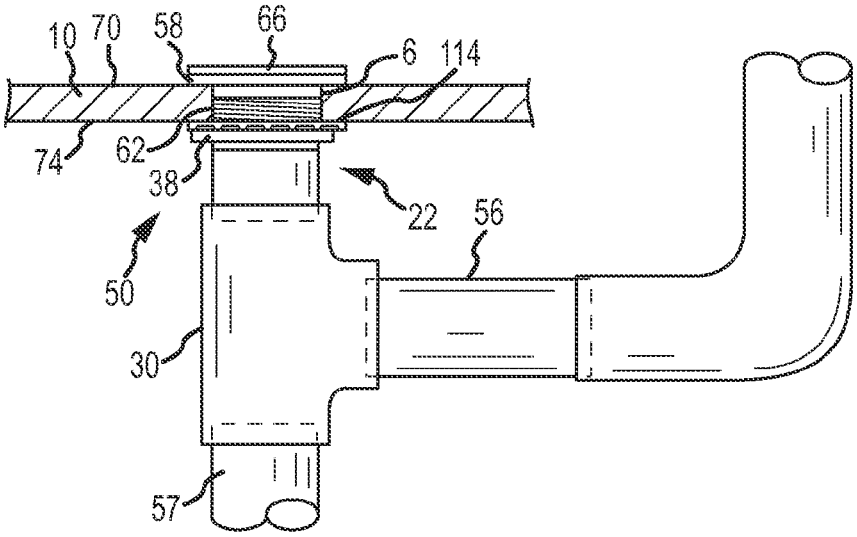
FIG. 4 is a side elevation view of another embodiment of a drain assembly interconnected to a bottom wall of the bathtub.
Figure 5:
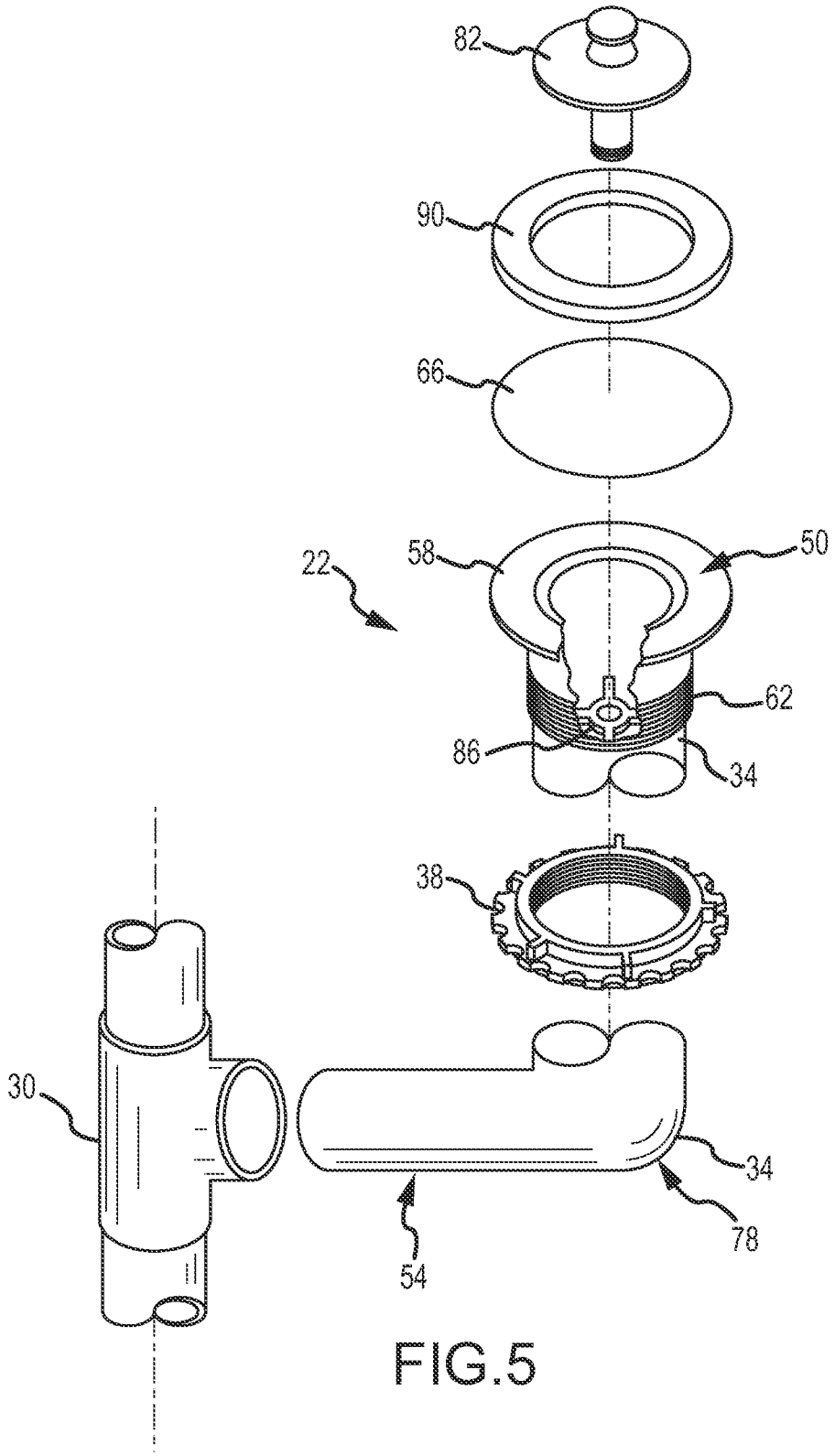
FIG. 5 is an exploded perspective view of one embodiment of a drain assembly and a tee connector.
Figure 6:
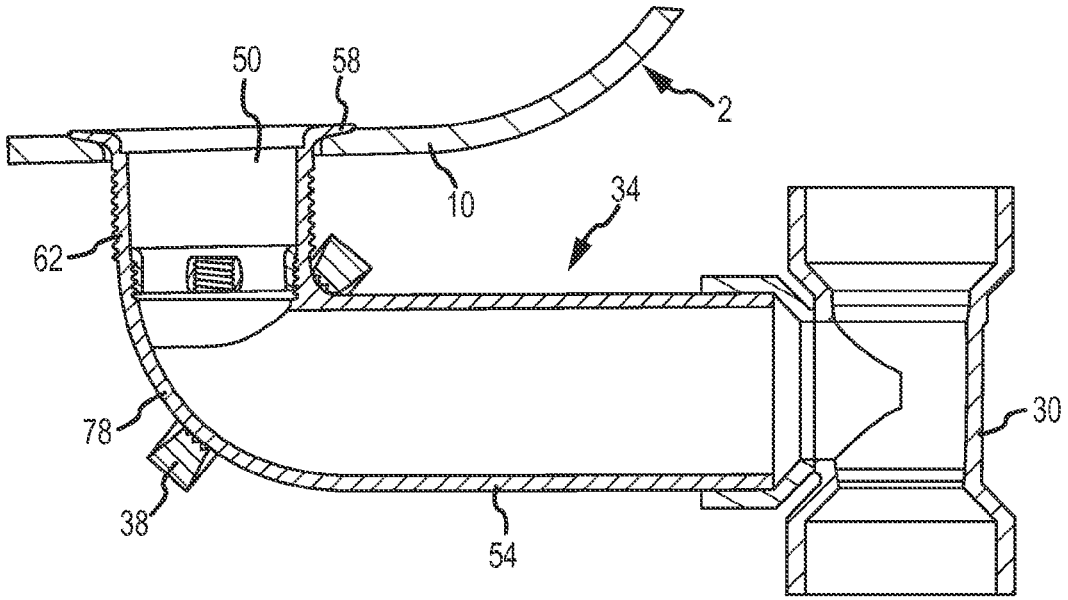
FIG. 6 is a cross-sectional view of another embodiment of a drain assembly interconnected to a tee connector.
Figure 7:
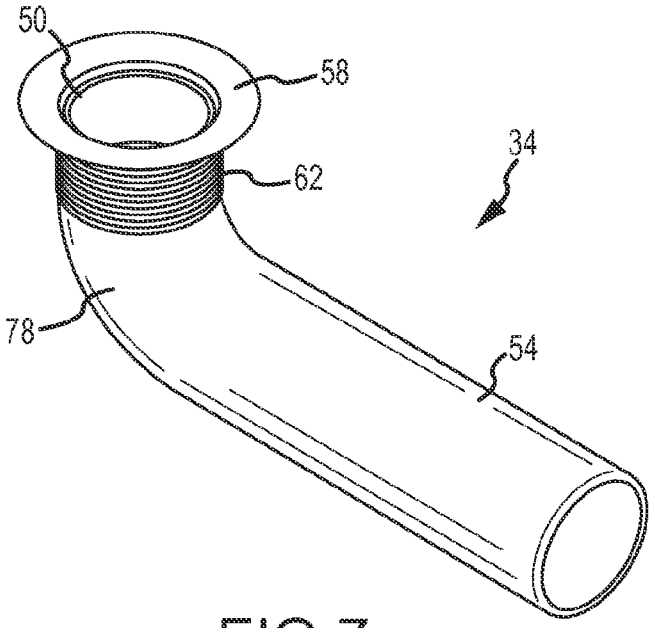
FIG. 7 is a perspective view of a drain pipe of one embodiment of the present invention.
Figure 8:
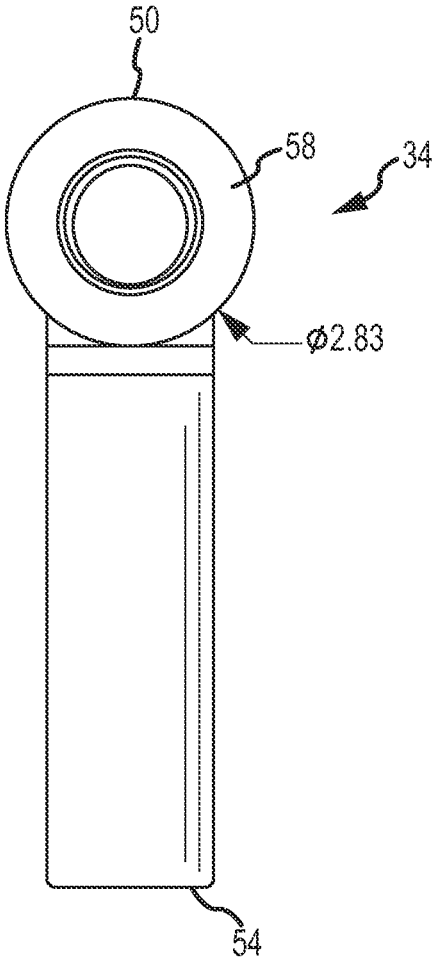
FIG. 8 is a top plan view of FIG. 7.
Figure 9:
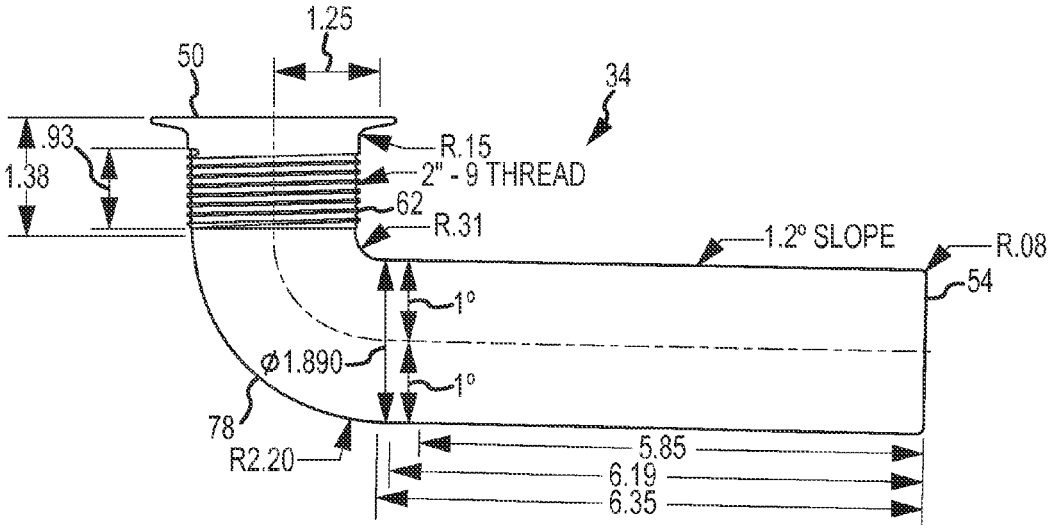
FIG. 9 is a front elevation view of FIG. 7.
Figure 10:
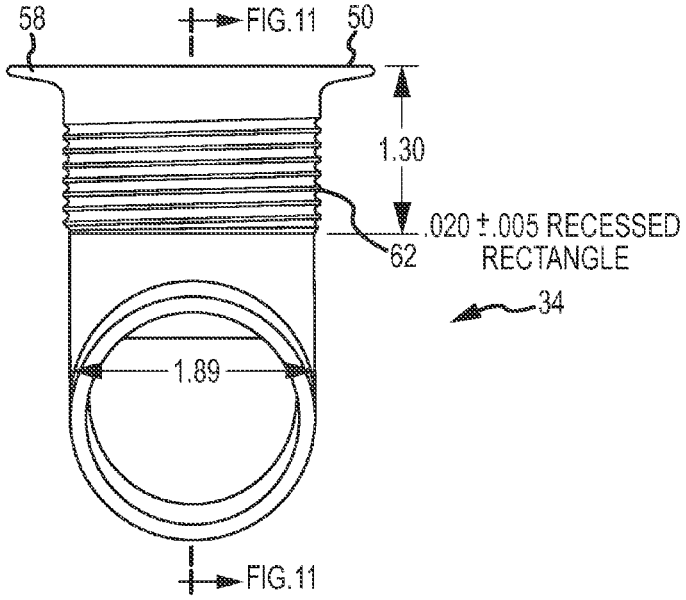
FIG. 10 is a right elevation view of FIG. 7.

FIGS. 3 and 4 show other methods interconnecting the drain pipe 34 to the primary drain 57. In FIG. 3, the drain includes an elbow that extends from the annular flange 58. The elbow 34 is interconnected to a pipe 56 by way of an adapter 55. The pipe 56 is also interconnected to a tee connector 30 that connects the primary drain 57 to a pipe associated with the overflow assembly (see FIG. 1, for example). In FIG. 4, the drain assembly includes a vertically-oriented pipe that extends from the annular flange 58. The drain assembly 22 is interconnected directly to the tee connector 30 which is also interconnected to the primary drain 57 and to a pipe 56 associated with the overflow assembly. These two alternate methods of interconnecting the drain assembly 22 provide more installation options and flexibility to the plumber. Those of skill in the art will appreciate that various other ways can be employed to interconnect the drain assembly 22 to the overflow assembly and to the primary drain plumbing 57 of the dwelling. For example, the portions of the drain assembly 22 that interconnect to the tee connector 30 or the primary drain 57 may be flexible as disclosed in U.S. 2008/0196161, which is incorporated by reference herein.

Figure 11:
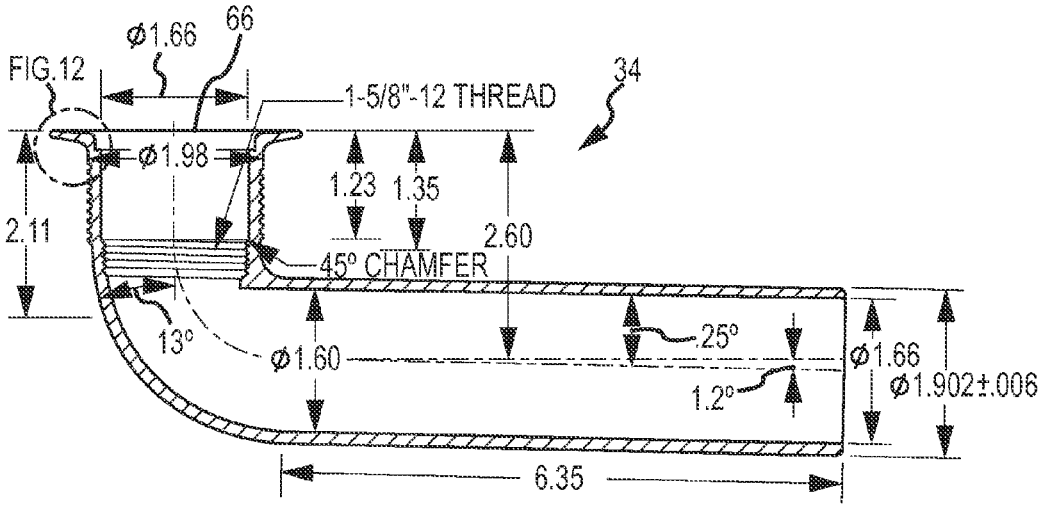
FIG. 11 is a cross-sectional view of FIG. 7.
Figure 12:
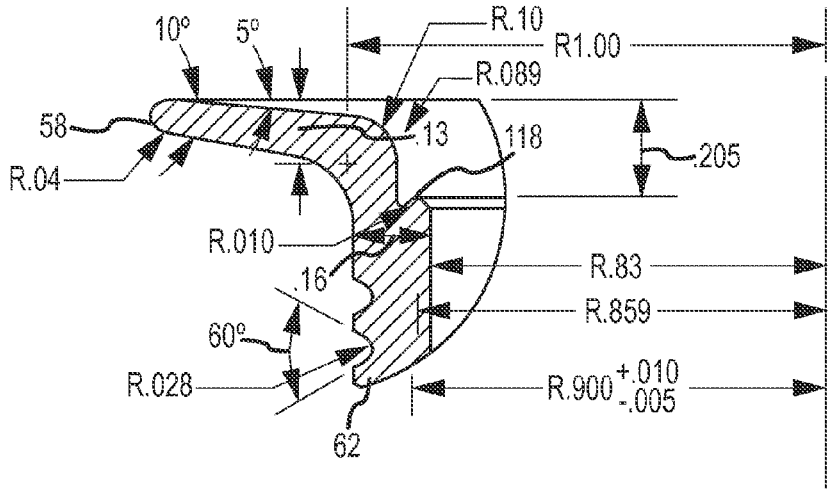
FIG. 12 is a detailed view of FIG. 11.

FIGS. 6-12 show the drain pipe 34 of one embodiment of the present invention, which is comprised of a first end 50 that includes the outwardly extending flange 58. The threads 62 referred to above are located under the flange 58. A second end 54 of the drain pipe 34 is connected to the first end 50 by way of an elbow 78. Because space is limited below the bathtub, it is advantageous to minimize the size of the elbow. However, the elbow must be large enough to allow for installation onto the bathtub and to accommodate the nut. In one embodiment of the present invention, the elbow 78 is interconnected to the second end 54, which may be schedule 40 pipe, by way of common plumbing interconnection methods. In another embodiment of present invention, the first end 50, elbow 78, and second end 54 are created in one molding process and, thus, comprise a single unit. The second end 54 of one embodiment meets Schedule 40 dimensions and tolerances such that it can be received into common drain fittings. Further, the second end, which comprises a generally horizontal portion of the drain pipe 34, may be angled about 0.25° relative to the horizontal plane defined by the outwardly-extending flange 58. Further, as shown in FIGS. 11 and 12, the first end 50 may be threaded on an inner surface thereof, which will be described in detail below. In addition, the first end may include a lip 118 for receiving the closure member, such as a membrane 66, which will also be described below.

The threads 62 are made in such a way to facilitate insertion of the drain pipe 34 into the drain port of a bathtub In one embodiment of the present invention, the threads 62 have squared or rounded off profile, i.e., comprised of recessed rectangles, such that they fit easily within the bathtub drain port. Because the drain pipe must fit through drain port openings as small as about 2.0 inches in diameter, the threaded portion's major diameter cannot be larger than the diameter of the drain port. The minor diameter of the threaded portion cannot be smaller than the drain pipe diameter. The length of the threaded portion must be long enough to accommodate the bottom wall thickness of the bathtub, but small enough to not adversely affect the size of the elbow 78.

The drain pipe 34 of one embodiment of the present invention is made of PVC per ASTM D1784-90, class 12454-B, and mechanically performs per ANSI/ASTM D-2466-90A. Further, the drain pipe 34 may be made of white pigmented PVC that may be chrome plated.

Figure 13:
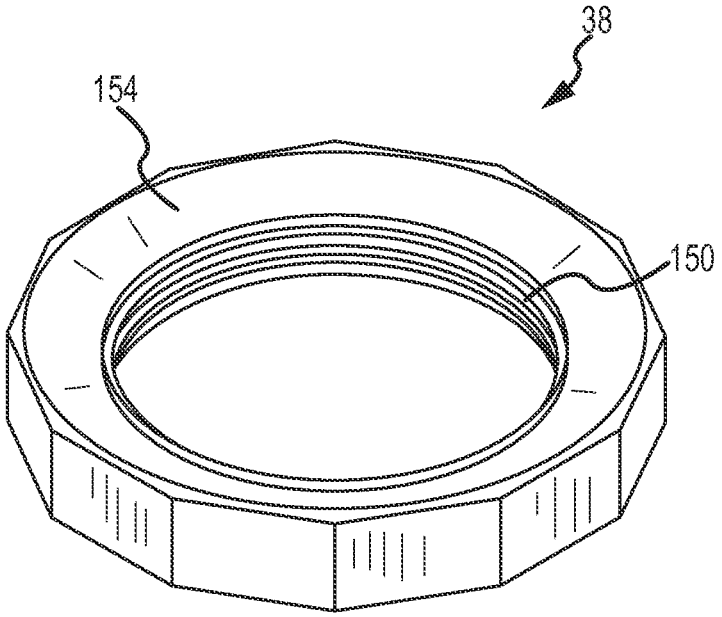
FIG. 13 is a perspective view of a nut used by one embodiment of the present invention.
Figure 14:
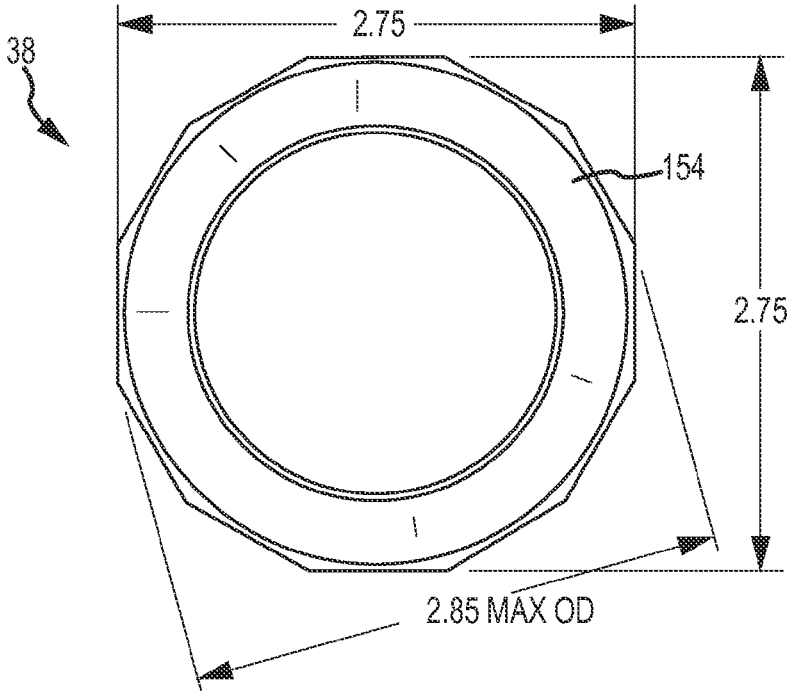
FIG. 14 is a top plan view of FIG. 13.
Figure 15:
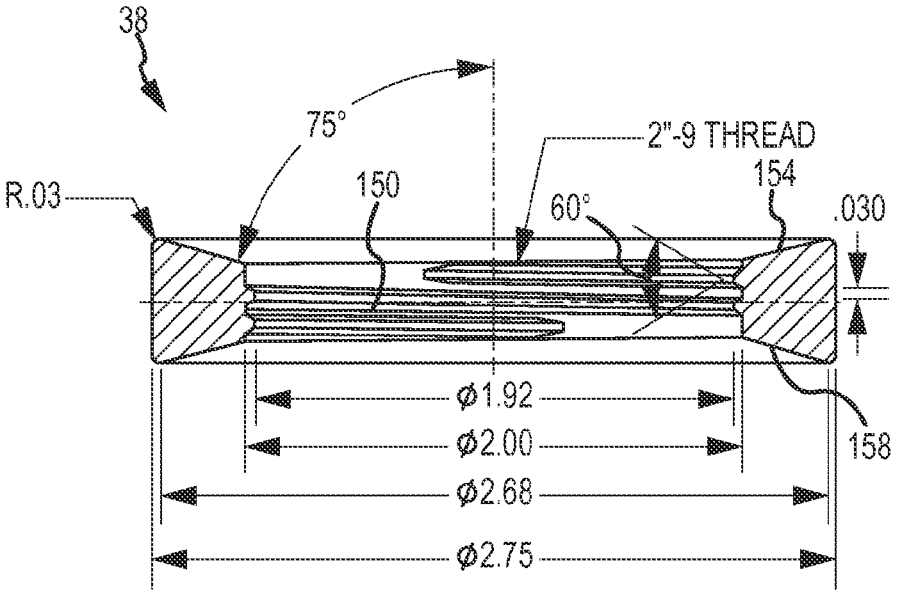
FIG. 15 is a cross-sectional view of FIG. 13.
Figure 16:
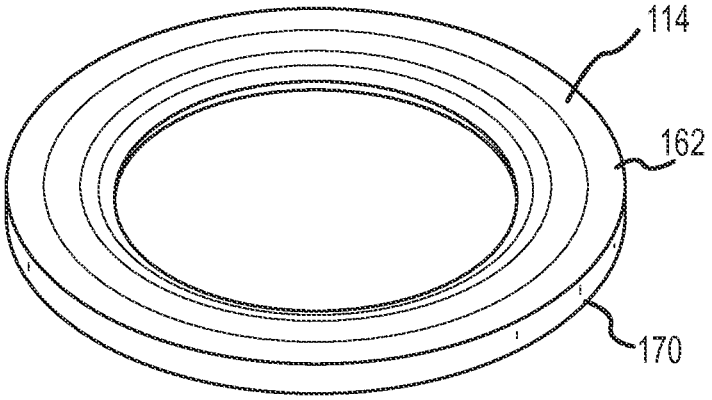
FIG. 16 is a perspective view of a sealing element used by one embodiment of the present invention.
Figure 17:
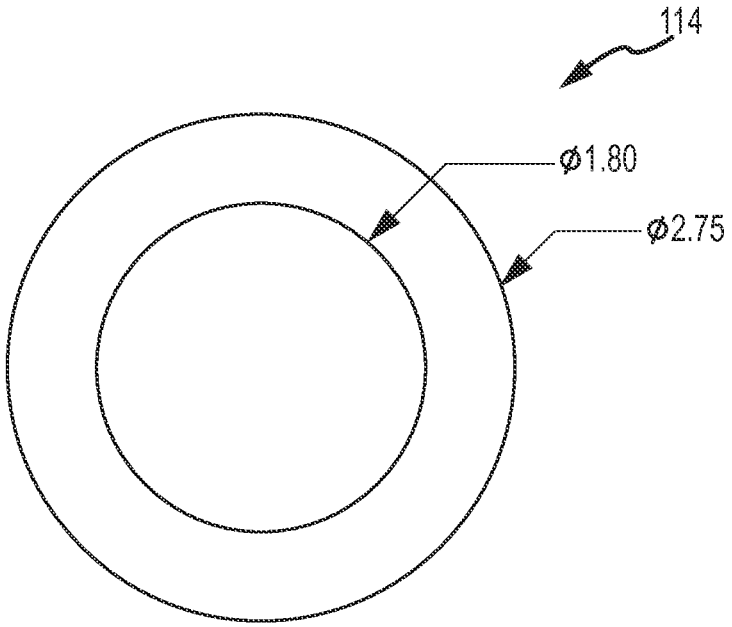
FIG. 17 is a top plan view of FIG. 16.
Figure 18:
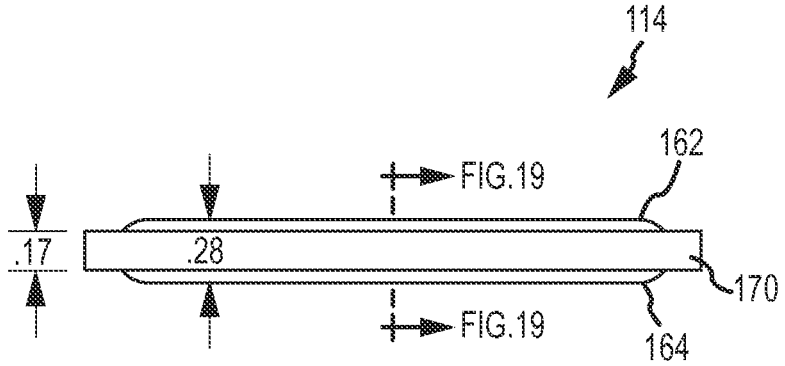
FIG. 18 is a side elevation view of FIG. 16.
Figure 19:
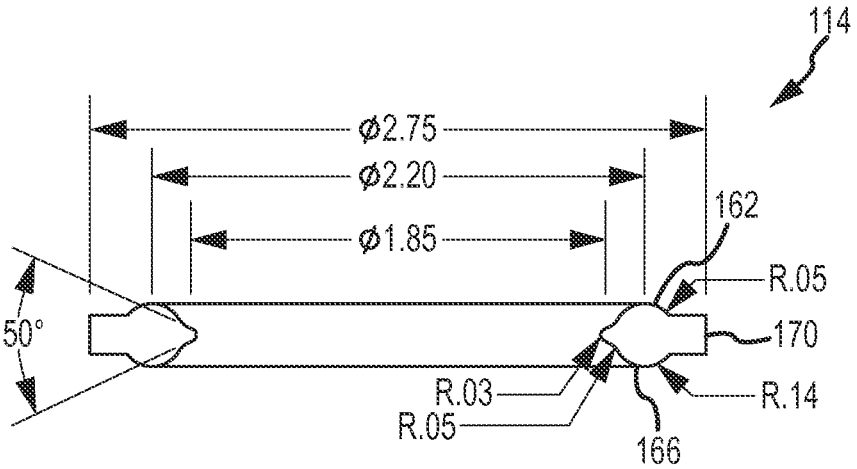
FIG. 19 is a cross-sectional view of FIG. 18.

FIGS. 13-15 show the nut 38 used in some embodiments of the present invention. The nut 38 includes internal threads 150 that selectively engage the exterior threads of the drain pipe. The nut 38 also includes generally frusto-conical upper surface 154 and lower surface 158. The upper and lower surfaces may alternatively possess a concavity for receipt of a sealing member, which would be described in detail below with respect to FIGS. 16-19. The internal diameter of the threads 150, which may have a profile commensurate of that of the drain pipe threads, are designed to fit over a schedule 40 drain pipe and be able to traverse the elbow without binding or difficulty.

Figure 2:
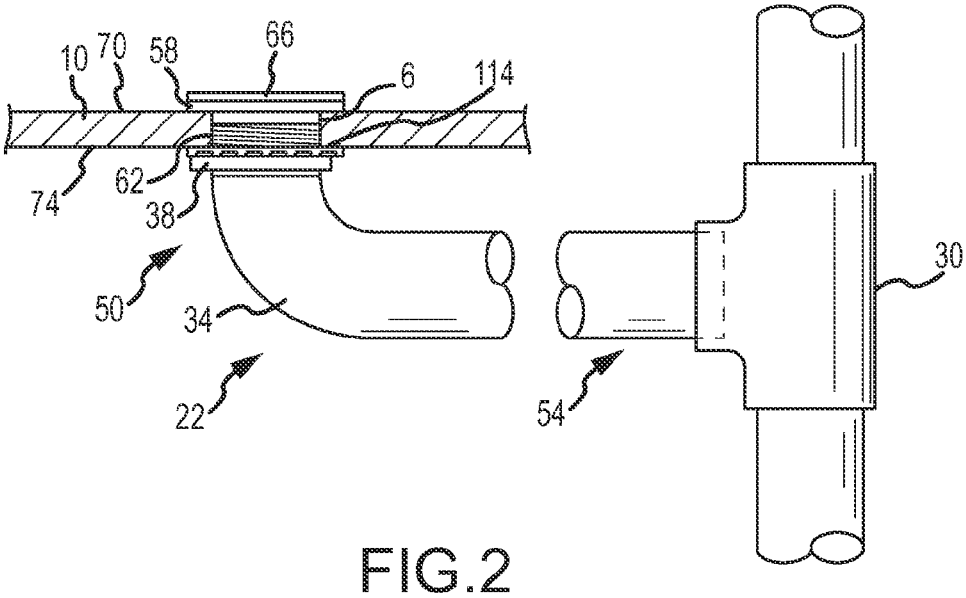
FIG. 2 is a side elevation view of one embodiment of a drain assembly interconnected to a bottom wall of the bathtub.

FIGS. 16-19 show the sealing member 114 used with some embodiments of the present invention. The sealing member 14 is designed to fit over the second end 54 of the drain pipe, transition around the elbow, and engaged the bottom surface of the bathtub as shown in FIG. 2. The sealing member 114 is held in place by the nut, which squeezes the sealing member 114 against the bottom surface of the bathtub when tightened. The contemplated sealing member 114 provides a tight connection, which may allow installers to forgo the use of sealing putty. In one embodiment of the present invention, the seal is made of an elastomeric material having a density of about 0.0361 pounds per cubic inch and weighs about 0.025 pounds. The surface area of the sealing member 114 is about 9.2 in.$^2$ The sealing member 114 of this embodiment of the present invention further may include an upper bulge 162 and a lower bulge 166 that are positioned internally to the outer surface 170 of the sealing member 114. The bulges are designed to interface with the frusto-conical surface of the nut to facilitate the tight interconnection between the drain pipe and the bathtub.

Figure 20:
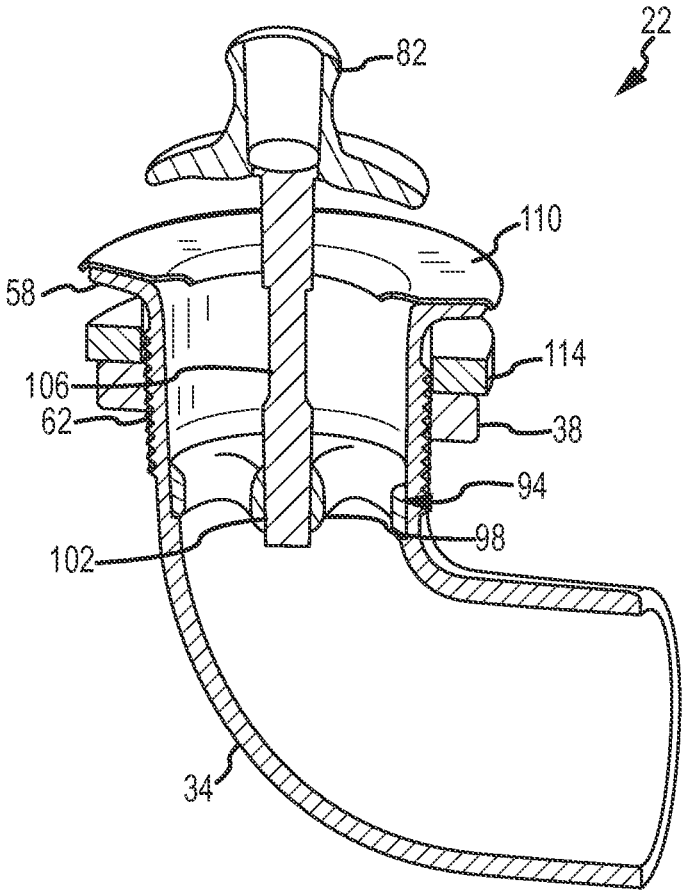
FIG. 20 is a cross-section perspective view of one embodiment of a drain assembly including a drain closure threadably engaged to a cross bar insert.

FIG. 20 depicts one embodiment of a drain assembly 22 that includes a drain closure 82 interconnected to a crossbar insert 94. The crossbar insert 94 includes a hub 98 having a threaded aperture 102 configured to receive a threaded end of a carrier 106 that slidingly receives the drain closure 82. The carrier 106 is inserted through a strainer body cover 110, which is interconnected to the flange 58. As in the embodiments described above, a nut 38 is threadably engaged onto the threaded portion 62 with a sealing element 114 positioned therebetween.

Figure 21:
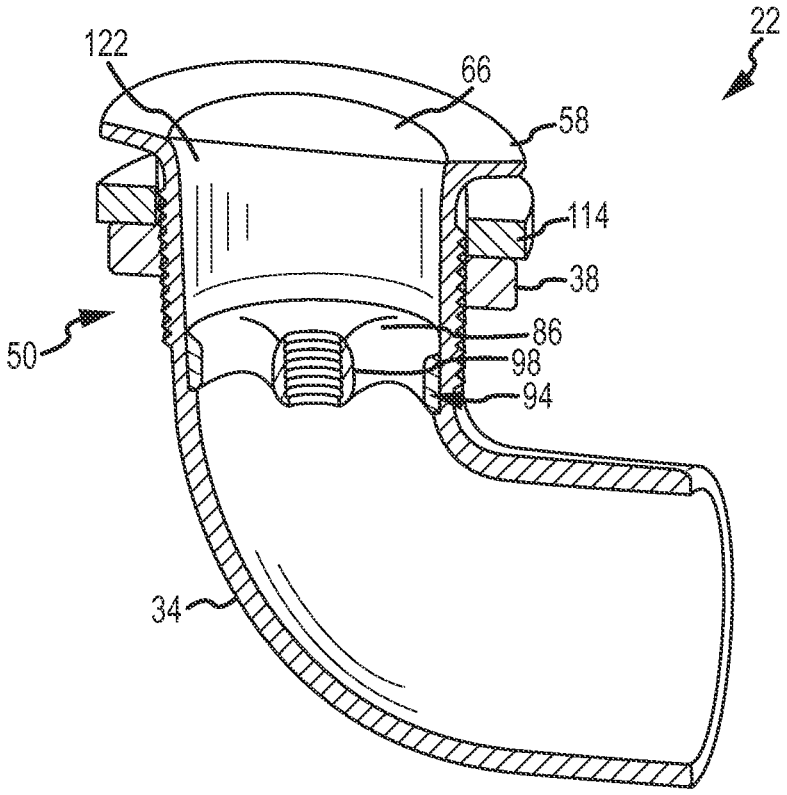
FIG. 21 is a cross-section perspective view of one embodiment of a drain assembly including a membrane and a cross bar insert.
Figure 22:
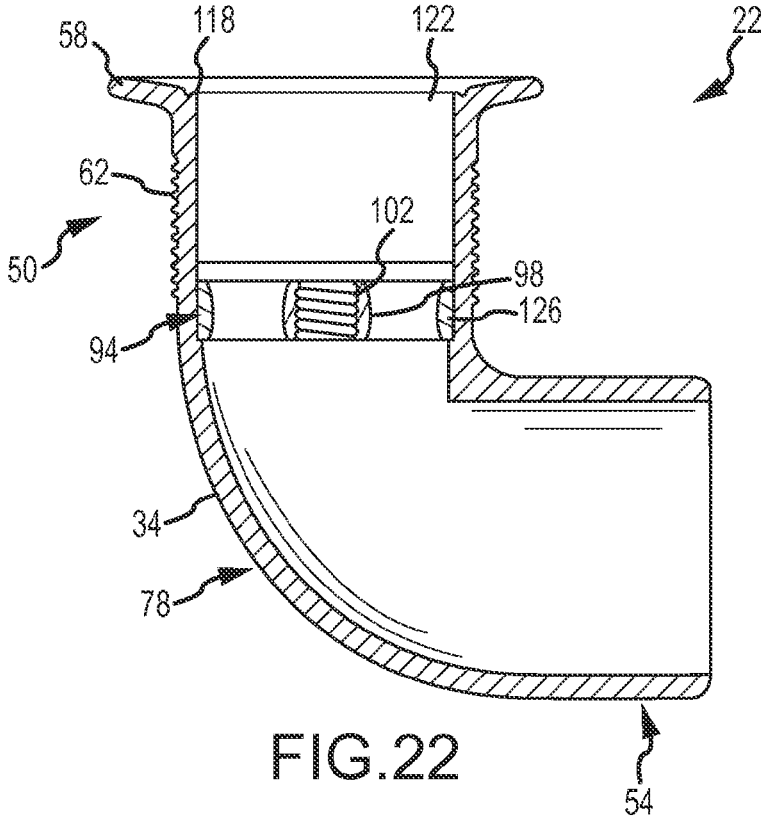
FIG. 22 is a cross-section elevation view of one embodiment of a drain assembly including a crossbar insert.

FIGS. 21 and 22 illustrate one embodiment of a drain assembly 22 that employs a membrane 66 and a crossbar insert 94 having a threaded hub 98. The membrane 66 is positioned over at least a portion of the flange 58 or affixed to an annular lip 118 of the drain closure 34 at the first end 50 of the drain elbow 34. The annular lip 118 is formed in the upper surface of the annular flange 58 as the flange 58 transitions to the interior surface 122 of the first end 50 of the drain pipe 34. In an alternative embodiment, the annular lip 118 is formed in an interior surface of the first end 50 of the drain pipe 34. The annular lip 118 can be configured to interconnect various devices to the drain pipe 34, including, but not limited to, a membrane 66, a cover 110, and a strainer body.

Figure 23:
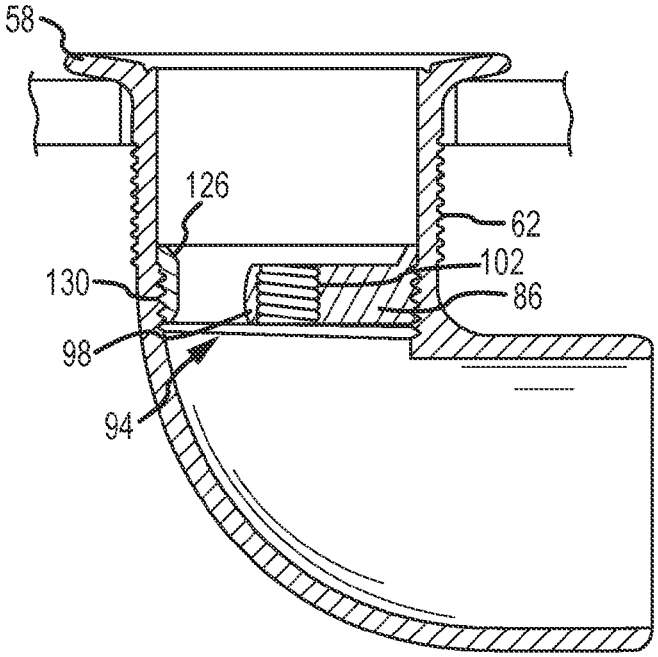
FIG. 23 is a cross-section elevation view of one embodiment of a drain assembly including a threaded cross bar insert.
Figure 24:
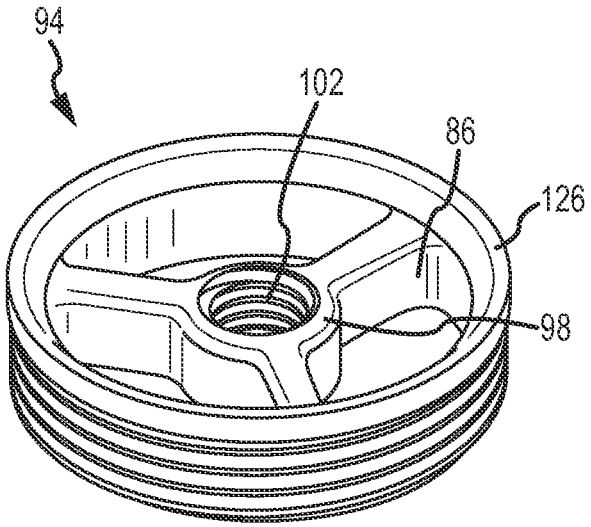
FIG. 24 is a perspective view of a crossbar insert used in conjunction with some embodiments of the present invention.
Figure 25:
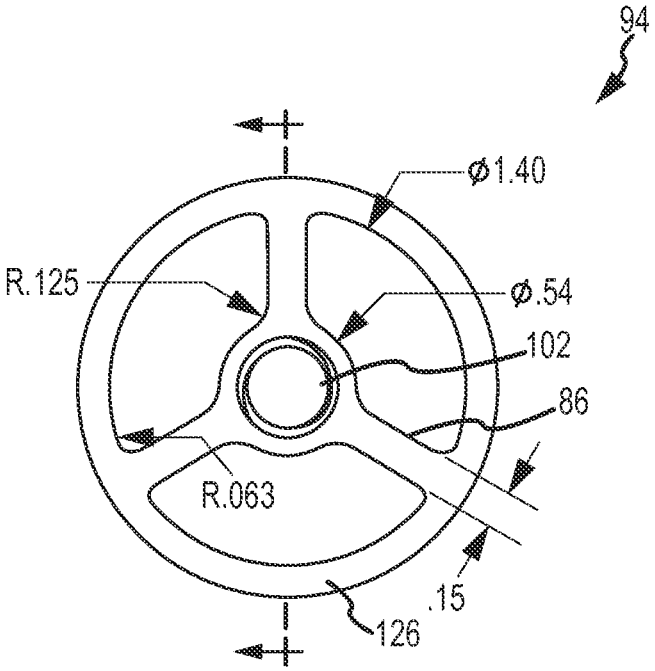
FIG. 25 is a top plan view of FIG. 24.
Figure 26:
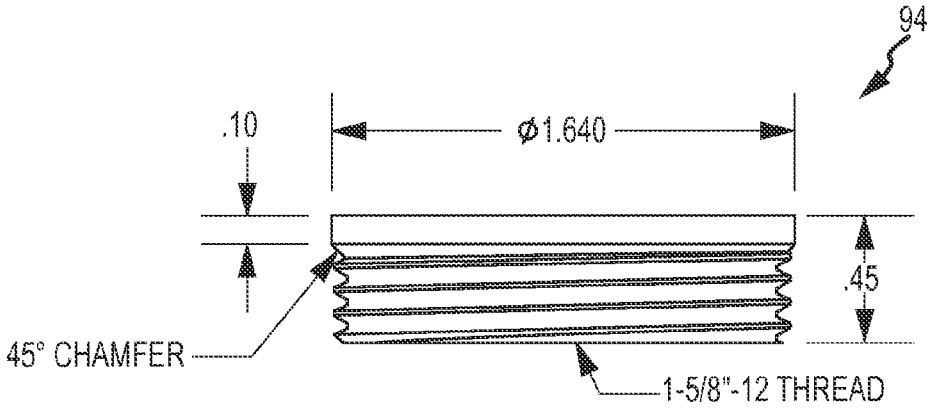
FIG. 26 is a side elevation view of FIG. 24.
Figure 27:
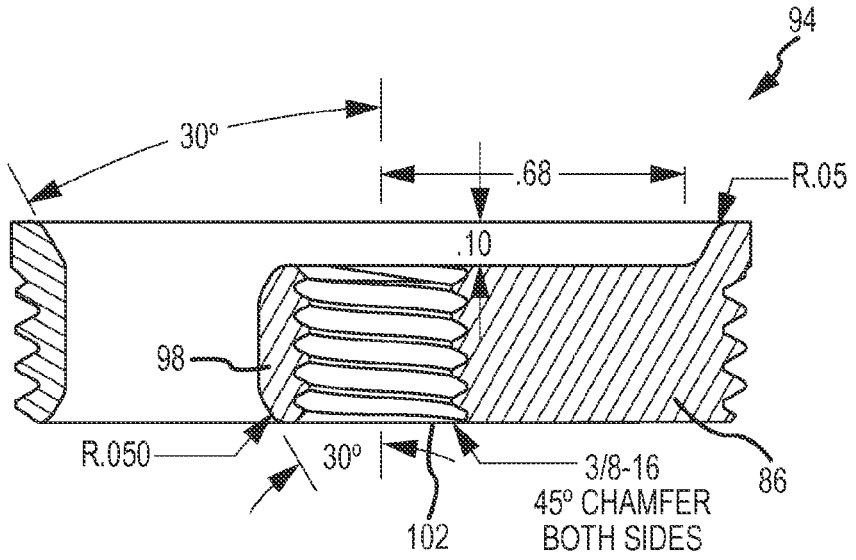
FIG. 27 is a cross-sectional view of FIG. 26.

Referring to FIGS. 22 and 23, various ways of positioning crossbars within the drain pipe are depicted. In one embodiment, the crossbar 94 is interference fit into the drain pipe 34. The crossbar insert 94 includes the at least one crossbar 86 that interconnects an annular ring 126 to the hub 98. The hub 98 may include a threaded aperture 102 configured to threadably receive the threaded end of a carrier, which operatively receives a drain closure 82.

Figure 28:
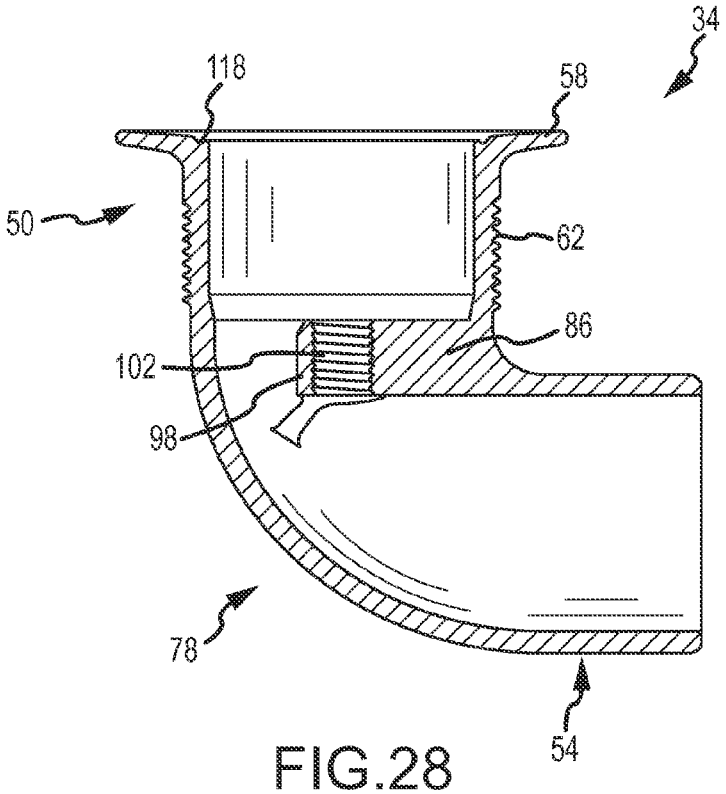
FIG. 28 is a cross-section elevation view of one embodiment of a drain pipe including an integral crossbar for receipt of a drain stopper carrier.

Referring to FIGS. 23-27, a crossbar insert 94 includes a threaded annular ring 126 that threadably engages a threaded portion 130 of the drain pipe 34. The crossbar insert 94 may alternatively have a smooth outer surface for interference fit within the internal diameter of the drain pipe 34 as shown in FIG. 22. Alternatively, the crossbars 86 may be integrally formed in the drain pipe 34 as shown in FIG. 28.

Figure 29:
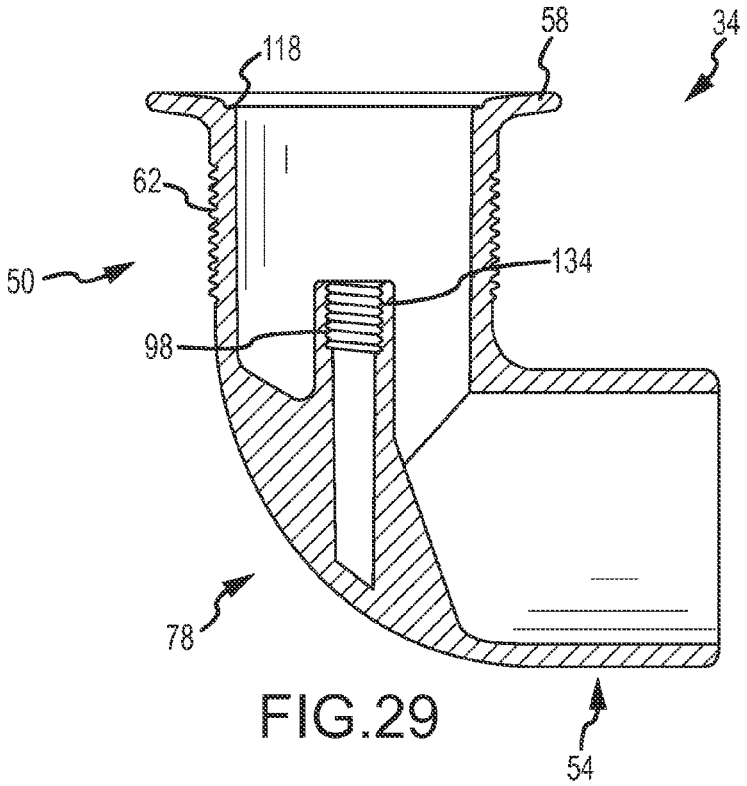
FIG. 29 is a cross-section elevation view of one embodiment of a drain pipe including an upwardly-extending hub for receipt of a drain stopper carrier.
Figure 30:
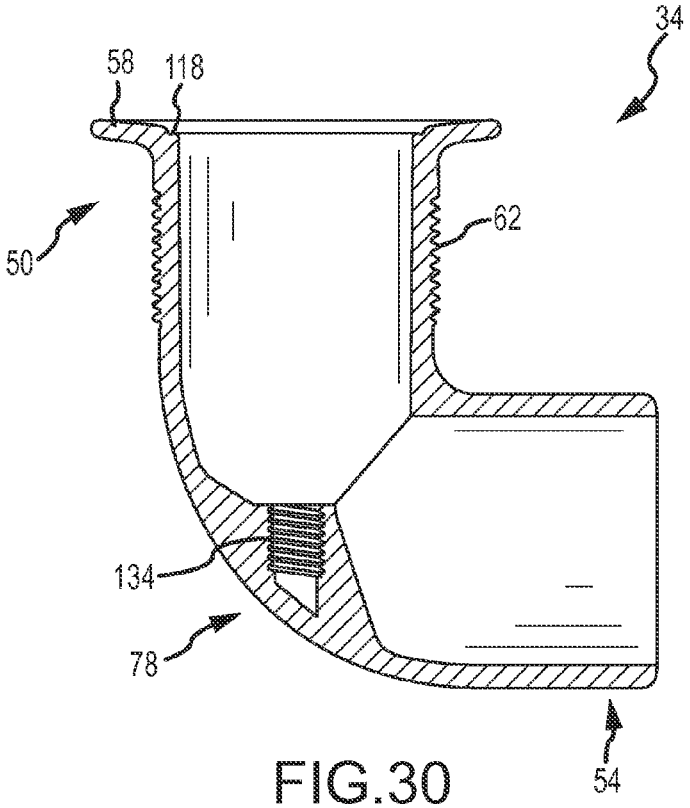
FIG. 30 is a cross-section elevation view of one embodiment of a drain pipe including a threaded hole formed in the elbow portion that receives a drain stopper carrier.

FIGS. 29 and 30 illustrate other methods of integrating a hub for the receipt of a drain closure mechanism with the drain pipe. In FIG. 29, an upwardly extending hub 98 is integrally connected to the elbow 78 of the drain pipe 34. The hub 98 extends into an interior space near the first end 50 of the drain pipe 34 and includes a threaded hole 134 that receives a threaded end of the carrier 106.

Figure 31:
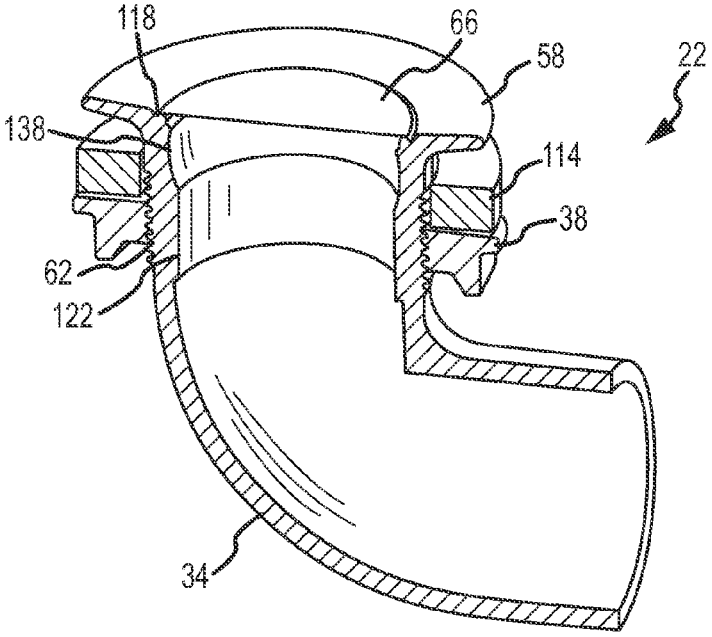
FIG. 31 is a cross-section perspective view of a drain assembly including a membrane, a nut, a sealing element, and a drain pipe having a concave inner surface.
Figure 32:
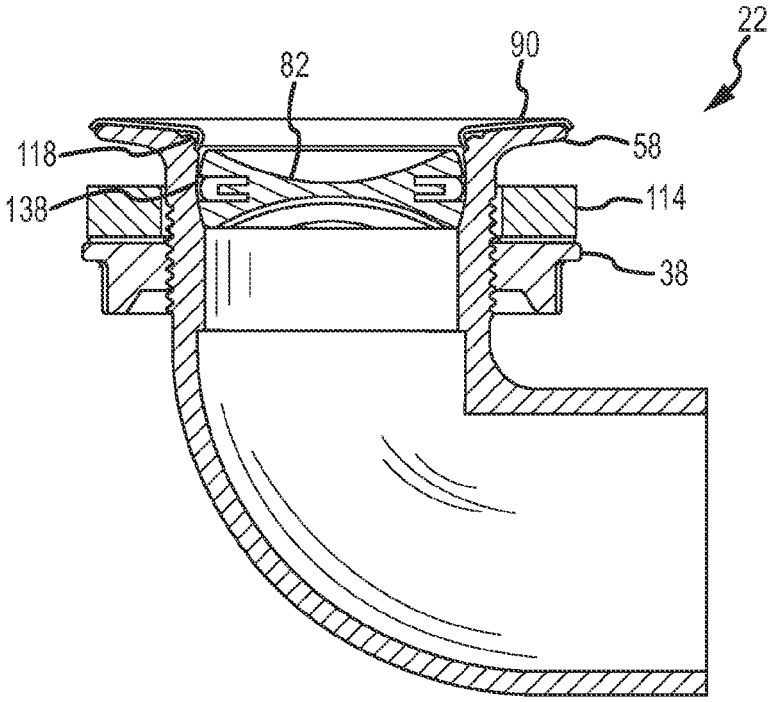
FIG. 32 is a cross-section elevation view of one embodiment of a drain assembly including a finishing plate and a drain closure interconnected to a drain pipe.
Figure 33:
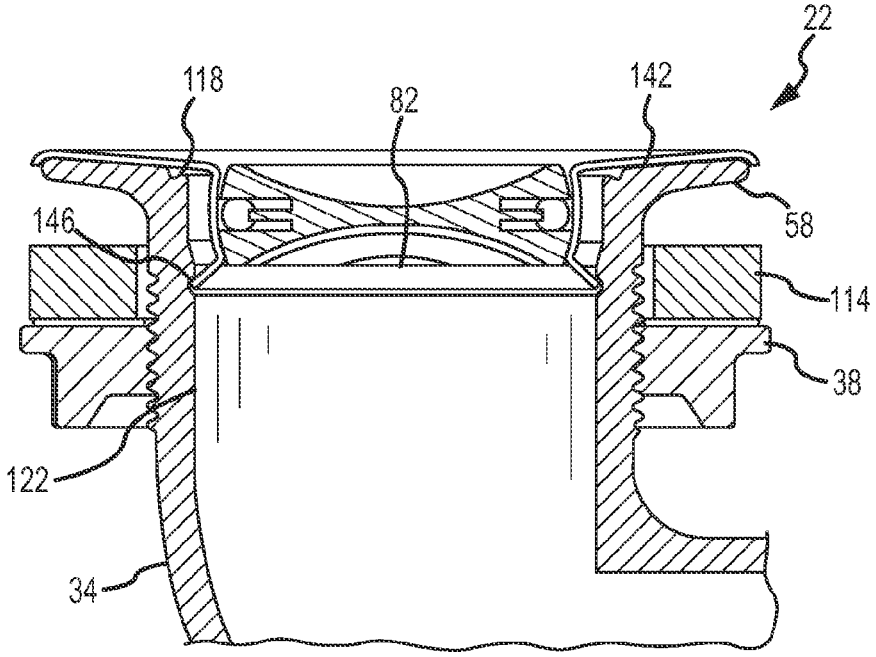
FIG. 33 is a cross-section elevation view of one embodiment of a drain assembly including downwardly-extending finishing plate with a drain closure associated therewith.

Referring now to FIGS. 31-33, various embodiments of a drain assembly 22 utilizing a drain closure 82 are provided. FIG. 31 depicts a drain pipe 34 that includes a concave portion 138 formed in an interior surface 122 that is configured to receive a drain closure 82 that is snapped or interference fit within the concave portion 138 of the drain pipe 34. In one embodiment, the concave portion 138 of the drain pipe 34 receives a PRESFLO™ drain closure. Also illustrated in FIG. 32, a cover 90, which often includes a strainer, may be interconnected to the drain pipe 34 to prevent hair from entering the drain pipe, for example. In one embodiment, the cover 90 is interference fit into the annular flange 58 and the annular lip 118 of the drain pipe 34.

FIG. 33 shows a drain closure insert 142 that is interconnected to the drain pipe 34 and is capable of accommodating the drain closure device, such as a PRESFLO™ drain closure. The drain closure insert 142 may alternatively have exterior threads that selectively engage threads located on the inside of the drain pipe 34 similar to that shown in FIG. 23.

The drain assembly as described herein may be used in conjunction with a foot-actuated drain stopper as taught by U.S. patent application Ser. No. 13/912,421, filed Jun. 7, 2013, which is incorporated by reference in its entirety herein. The drain stopper disclosed in U.S. Pat. No. 5,758,368 (Lift and Turn), U.S. Pat. No. 6,066,119 (PRESFLOW), and U.S. Pat. No. 6,418,570 (push/pull), may be used with respect to embodiments the present invention. Further, inserts, which conceal the outer surface of the outwardly extending flange of the drain pipe may be used in conjunction with embodiments of present invention. Such devices are disclosed in U.S. Pat. No. 5,745,931 and U.S. Pat. No. 7,503,083, and pending patent applications related thereto. Such patents and pending applications being incorporated by reference herein.

While various embodiments have been described herein in detail, it is apparent that modifications and alterations of those embodiments will occur to those skilled in the art. It is to be expressly understood that such modifications and alterations are within the scope and spirit of the claimed invention, as set forth in the following claims.

What is claimed is:

1. A drain assembly adapted for interconnection to a tub having a drain port formed in a bottom wall, the drain port having a diameter, the drain assembly comprising:

a drain pipe including a first portion, a second portion, and an elbow portion positioned between, and integrally connecting, said first portion and said second portion, said first portion including an annular flange and a threaded portion positioned between said annular flange and said elbow portion, wherein said threaded portion, said elbow portion, and said second portion have a diameter that is less than the diameter of the drain port, and wherein said annular flange has a maximum diameter that is larger than the diameter of the drain port; and a nut configured to threadably engage said threaded portion of said drain pipe to secure said drain pipe to the bottom wall of the tub.

2. The drain assembly of claim 1, further comprising at least one sealing element positioned between the annular flange and the nut.

3. The drain assembly of claim 1, wherein said first portion further comprises a lip associated with the inner surface and adjacent to an upper surface of said annular flange.

4. The drain assembly of claim 3, further comprising a membrane interconnected to said lip.

5. The drain assembly of claim 3, further comprising a means for accommodating a drain stopper associated with an inner surface of said first portion.

6. The drain assembly of claim 1, wherein said threaded portion is comprised of a series of blunted threads.

7. The drain assembly of claim 1, wherein said nut has an upper surface and a lower surface, said surfaces having a frusto-conical shape.

8. The drain assembly of claim 7, further comprising a seal that is adapted to contact said upper surface and the bottom surface of the bathtub.

9. The drain assembly of claim 8, wherein said seal includes a bulge on least an upper surface and a lower surface thereof.

10. The drain assembly of claim 1, further comprising crossbars integrally formed within the first portion of said drain pipe.

11. The drain assembly of claim 1, further comprising a membrane interconnected directly to the annular flange.

12. A drain elbow adapted for interconnection to a tub having a drain port formed in a bottom wall, the drain port having a diameter, the drain elbow comprising:

a first portion including an annular flange and an externally threaded portion, said annular flange having a maximum diameter that is larger than the diameter of the drain port;

a second portion; and an elbow portion positioned between, and integrally connecting, said first portion and said second portion, wherein said externally threaded portion is positioned between said annular flange and said elbow portion, and wherein said externally threaded portion, said elbow portion, and said second portion have a maximum diameter that is less than the diameter of the drain port.

13. The drain elbow of claim 12, wherein said first portion further comprises a lip formed in an upper surface of said annular flange adjacent to an opening of said drain elbow, wherein said lip is configured to receive at least one of a membrane and a strainer body cover.

14. The drain elbow of claim 12, further comprising a crossbar interconnected to an interior surface of said drain elbow.

15. The drain elbow of claim 14, wherein said crossbar is integrally formed in said interior surface of said drain elbow.

16. The drain elbow of claim 14, wherein said crossbar is threadably secured to said interior surface of said drain elbow.

17. The drain elbow of claim 14, wherein said crossbar is interference fit within said interior surface of said drain elbow.

18. The drain elbow of claim 14, wherein said crossbar includes a hub having a threaded aperture configured to receive a threaded post of a drain closure.

19. The drain elbow of claim 12, wherein an interior surface of said first portion includes a concave portion configured to receive a drain closure.

* * * * *